US005083393A

United States Patent [19]

Smydas

[11] Patent Number: 5,083,393

[45] Date of Patent: Jan. 28, 1992

[54] CARTRIDGE CLIP LOADING/UNLOADING TOOL

[76] Inventor: Eugene I. Smydas, 4002B E. 11th Street, Panama City, Fla. 32404

[21] Appl. No.: 683,796

[22] Filed: Apr. 11, 1991

[51] Int. Cl.[5] ..... F41A 9/85

[52] U.S. Cl. ..... 42/90; 42/89

[58] Field of Search ..... 42/87, 88, 89, 90

[56] References Cited

U.S. PATENT DOCUMENTS

| | | | |
|---|---|---|---|
| 923,068 | 5/1909 | Neal | 42/89 |
| 1,202,342 | 10/1916 | Wesson | 42/89 |
| 1,202,343 | 10/1916 | Wesson et al. | 42/89 |
| 2,451,521 | 10/1948 | Uglum | 42/87 |
| 3,182,417 | 5/1965 | Hamilton | 42/89 |

*Primary Examiner*—Charles T. Jordan

*Attorney, Agent, or Firm*—John K. Donaghy

[57] ABSTRACT

A cartridge clip loading/unloading device comprising a base; a post on the base having a terminal end; a clip having slots supported on the post at the terminal end; a tool having a first arm supported for rotation on the post; and a second arm having means for pressisng cartridges onto or out of the clip.

11 Claims, 3 Drawing Sheets

CARTRIDGE CLIP LOADING/UNLOADING TOOL

BACKGROUND OF THE INVENTION

1. Field of the Invention

This invention pertains to a device for the loading and/or unloading of ammunition cartridge clips—often referred to as moon clips.

2. Background of the Prior Art

Cartridge clips for use with pistols such as 0.45 caliber revolvers were heretofore loaded and unloaded by cumbersome and time consuming methods which often result in hand injury to the loader.

Representative of prior art cartridge clips are shown in U.S. Pat. Nos. 1,202,342 and 1,202,343.

SUMMARY OF THE INVENTION

This invention addresses the need for a device for facilitating the loading of live 0.45, caliber cartridges onto a cartridge clip, and for unloading empty cartridges from such clip.

It is therefore one object of this invention to provide a tool which facilitates easy loading or unloading of cartridge clips with ammunition.

It is another object of this invention to provide a tool with a cartridge clip supporting fixture which, when used in combination with the tool, facilitates easy loading and unloading of cartridges in a simple and easy manner.

It is yet another object of this invention to provide a tool having a stationary handle supported on the fixture and a moveable handle having cooperating members for loading or unloading an ammunition cartridge into or out of a cartridge clip.

Another object of this invention is to provide a cartridge clip and tool support device which cooperate together to facilitate insertion of ammunition cartridges into or out of a cartridge clip.

These and other objects of this invention will become apparent to those skilled in the art to which the invention pertains from a reading of the following specifications when used in conjunction with the annexed drawings hereto.

DESCRIPTION OF THE PREFERRED EMBODIMENT OF THE INVENTION

Figure 7:
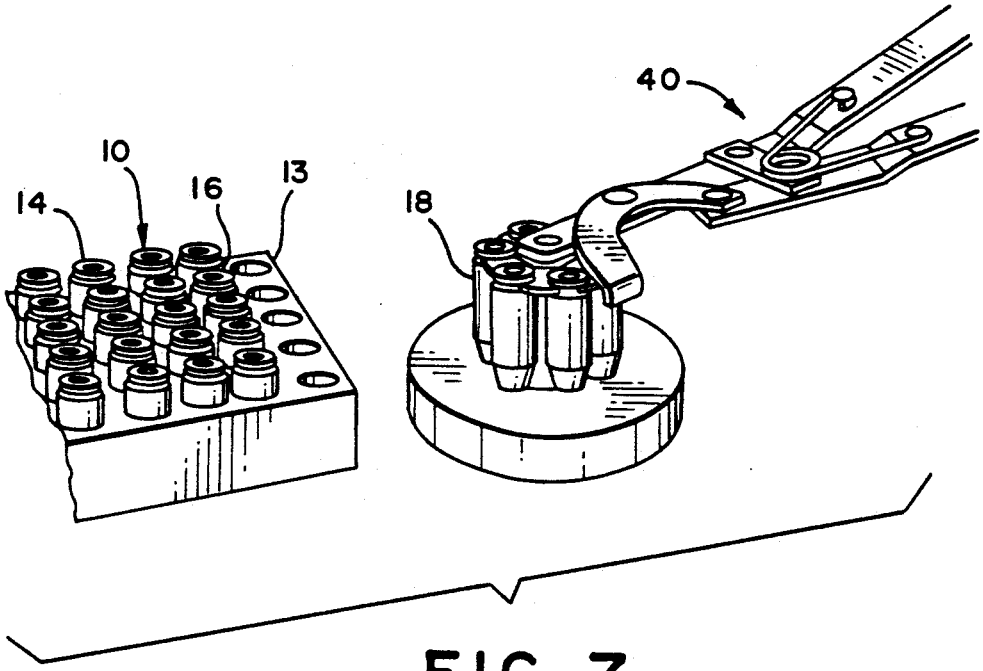
FIG. 7 is a perspective view of the tool and cartridge clip supported on the support device.
Figure 8:
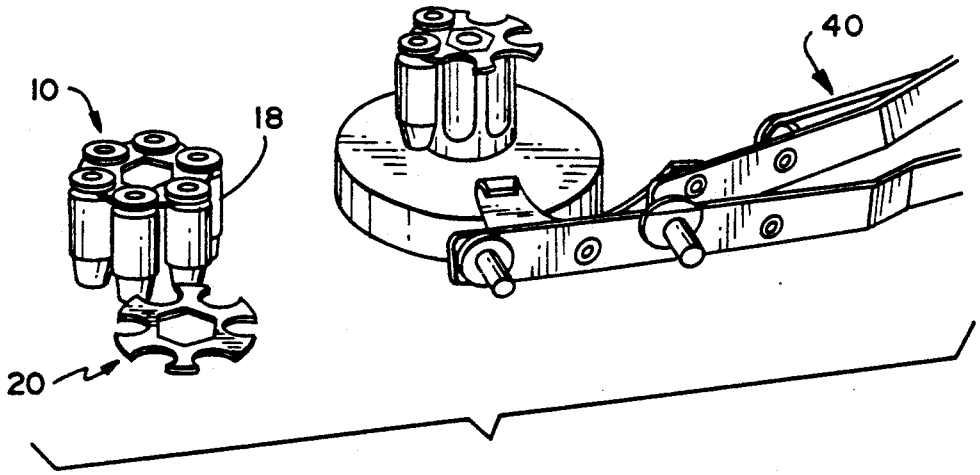
FIG. 8 is a perspective view of the tool separated from the support device.

Turning now to the drawings in more detail, FIGS. 7–8 show ammunition cartridges 10 in a typical container 13.

The cartridges 10 have a conventional rim 14, recess 16 and a cylindrical body 18. In the past, the cartridges 10 were mounted into the cylinder of a pistol, one-by-one, by hand. This was cumbersome and time consuming.

In order to facilitate the placement of a full load of cartridges 10 into the cylinder of a revolver as a unit, the clip 20 is useful.

Figure 4:
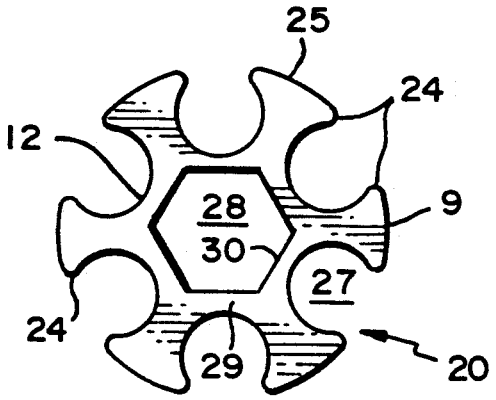
FIG. 4 is a perspective view of a cartridge clip with cartridge receiving slots.

The clip 20, FIGS. 4 and 8, has six tabs 9 having inner semi-circular sides 12 terminating in projecting tabs 24 and outer sides 25. The clip has an opening 28 with six sides 30 circumscribing the opening. The clip 20 is designed to hold six cartridges 10 each one being supported in the slot 27 defined by the sides 12 and tabs 24 which fit into the recess 16.

In the past, the cartridges 10 were loaded into the slots by hand and this was time consuming and often resulted in injury to the hands of the loader.

Figure 1:
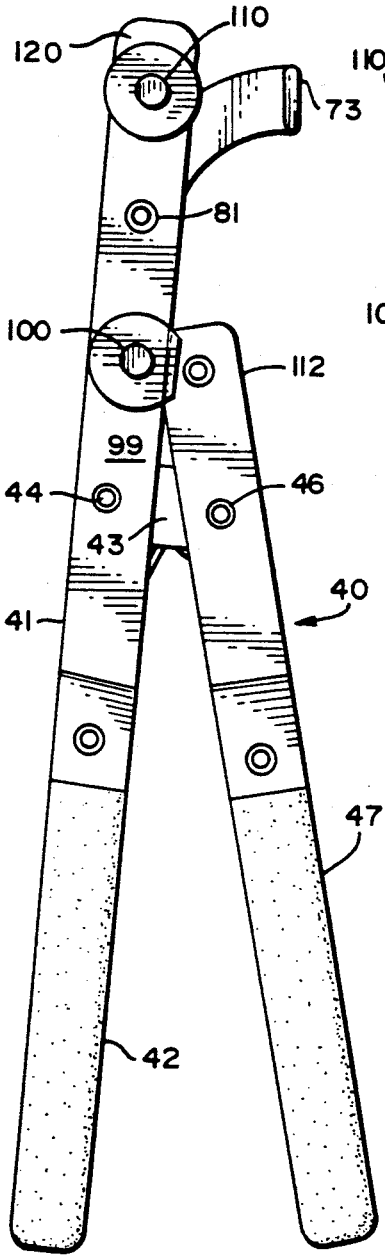
FIG. 1 is a bottom view of the tool of this invention showing a stationary arm and a moveable arm.
Figure 2:
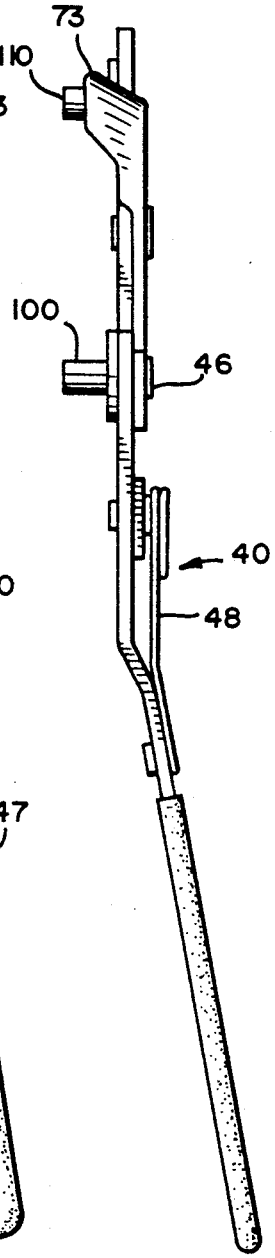
FIG. 2 is a side view of the tool shown in FIG. 1.
Figure 3:
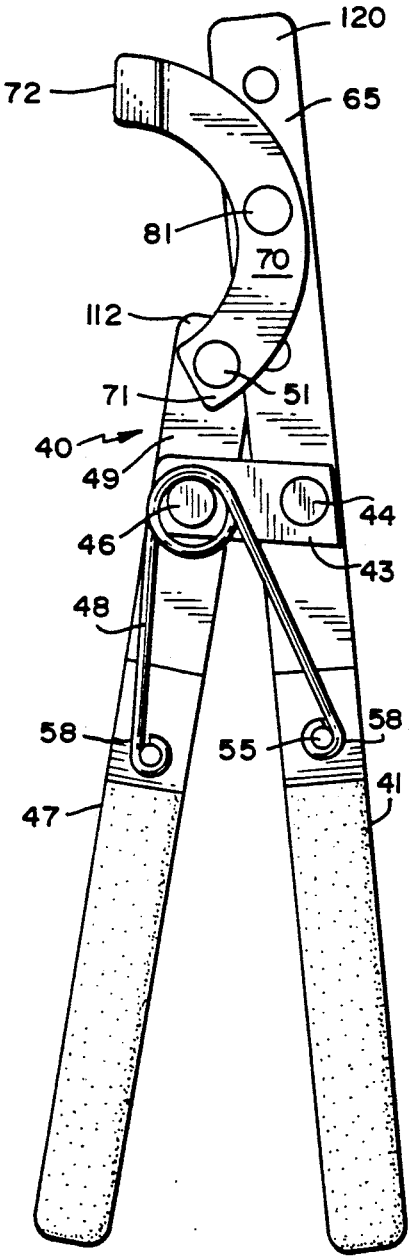
FIG. 3 is a top view of the tool shown in FIG. 1.
Figure 6:
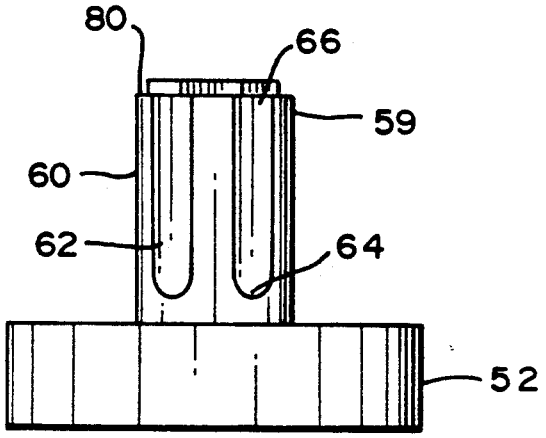
FIG. 6 is a side view of the cartridge support device of this invention showing side indentations.
Figure 5:
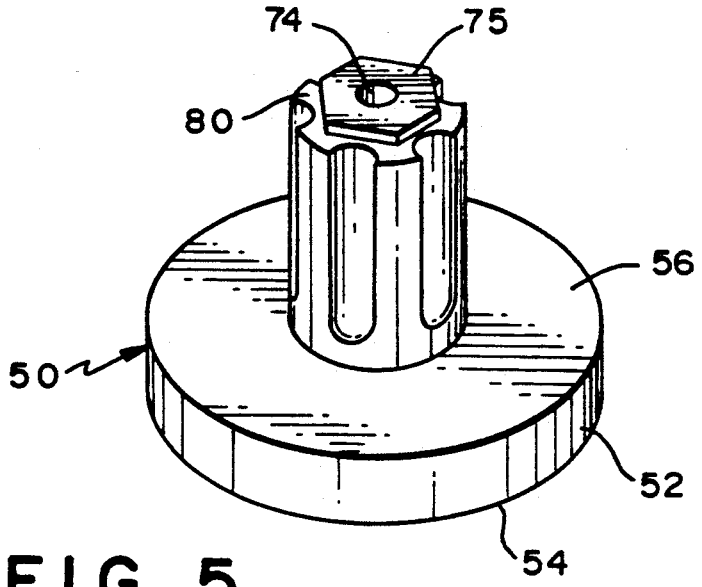
FIG. 5 is a perspective view of a cartridge clip support device with tool receiving aperture therein.

The tool 40, FIGS. 1–3, in cooperation with holder 50, FIGS. 5 and 6, facilitates loading of cartridges 10 into the clip 20. The holder 50 comprises a base 52 which, in these drawings, is disc-like and has a bottom 54 and a top 56. It will be understood that the holder 50 may be any shape. The top 56 has a vertical post 60 having a plurality of indentations 62 with rounded ends 64 and open ends 66. These indentations 62 are designed to receive the cylindrical walls 18 of cartridges 10. The terminal end 59 of post 60 has a top ledge 80 and hexagonal nut-like end 75 having a hole 74 in the center thereof. The nut-like end 75 receives the opening 28 of the clip 20 and the areas 29 adjacent the sides 30 are supported on the ledge 80. It will be seen that the base 52 is substantially larger than the post 60 whereby the base 52 does not rock when the clip 20 is being loaded or unloaded.

The tool 40, FIGS. 1–3, comprises a plier-like device having an arm 41 with handle 42 at one end. A bracket 43 is attached to arm 41 by a pin 44. Attached to the bracket 43 by a pin 46 is an arm 47. It will be understood that the arm 47 pivots on pin 46 and that spring 48 is positioned on the pin 46. The end 58 of the spring 48 is attached to arms 41 and 47 by pins 55 or the like. The terminal end 49 of arm 47 has a pin 51 which pivotally receives a semi-circular member 70 near its end 71. The semi-circular member 70 is attached for rotation to arm 41 by a pin 81. Thus, it will be evident that the semi-circular member 70 pivots on pins 51 and 81 when the arms 41 and 47 are compressed and released. The other end 72 of the semi-circular member 70 has a horizontal tab 73 which projects away from the end 72.

Arm 41 has a pin 100 extending outwardly of its bottom flat side 99 opposite the pivot point 51 of semi-circular member 70. Another pin 110 extends away from side 99 of arm 41 near its terminal end 120. Tab 73 of semi-circular member 70 is parallel to pin 110 and separated therefrom by a distance, FIGS. 1 and 2.

In operation, the clip 20 is placed on hexagonal nut-like member 75 of post 60. It will be seen that the sides 30 of the clip 20 mate with the hexagonal nut 75 whereby the clip 20 is prevented from rotating on the post 60. The operator places the pin 110 of the tool 40 into hole 74 of post 60 whereby the tool 40 is rotatably supported therein. A cartridge 10 is placed with its groove 16 against the projection 24 and arm 47 is squeezed whereby the semi-circular member 70 is rotated on pivot pins 51 and 80. As a result, the cartridge 10 is engaged by tab 73 which presses it into slot 27 of the clip 20 with the recess 16 abutting the sides 12. The cylindrical walls 18 of the cartridges 10 abut the indentations 62 of the vertical post 60. The cartridges 10 are loaded one-by-one onto the clip 20 in this fashion. Once loaded, the clip 20 is removed from the post 60 and the clip 20, with the six cartridges thereon, is easily and quickly loaded as a unit into the cylinder of a revolver.

The tool 40 may be used to remove the empty cartridges from the clip 20 by placing the clip 20 with empty cartridges on the post 60 and inserting the pin 100 into hole 74 of post 60. The arm 47 is squeezed such that its end or tip 112 moves outwardly and engages the rim 14 of the cartridge 10 forcing it out of the slot 27.

While the invention has been described with regard to a preferred embodiment thereof, it will be understood to those skilled in the art to which the invention pertains, that numerous changes may be made to the invention to enhance its effectiveness without departing from the spirit and scope thereof.

What I claim is:

1. A cartridge clip loading/unloading device comprising:

a base;

a post on the base having a terminal end;

a clip having slots supported on the post at the terminal end;

a tool having a first arm supported for rotation on the post; and a second arm having means for pressing cartridges into or out of the clip.

2. A cartridge clip loading/unloading device according to claim 1, wherein:

said post has indentations for receiving the cylindrical walls of a cartridge.

3. A cartridge clip loading/unloading device according to claim 2, wherein:

said terminal end of said post has a hexagonal nut-like configuration for receiving said clip.

4. A cartridge clip loading/unloading device according to claim 1, wherein:

said tool first arm comprises a stationary arm having a pin for attachment to said post.

5. A cartridge clip loading/unloading device according to claim 4, wherein:

said tool has a second arm having means associated therewith for pressing a cartridge into or out of said clip.

6. A cartridge clip loading/unloading device according to claim 5, wherein:

said means comprises a semi-circular member having means for engaging said cartridge for press-loading it into said clip.

7. A cartridge clip loading/unloading device according to claim 6, wherein:

said semi-circular member is pivotally attached to said moveable arm and to said stationary arm.

8. A cartridge clip loading/unloading device according to claim 1, wherein said tool comprises:

a stationary arm having a bracket thereon;

a moveable arm pivotally attached to the bracket;

a spring between the stationary arm and the moveable arm;

a cartridge engaging member attached to the stationary arm and the moveable arm; and at least one pin on said stationary arm for engaging said post.

9. A cartridge clip loading/unloading device according to claim 6, wherein:

said semi-circular member comprises a tab for engaging a rim on the cartridge.

10. A cartridge clip loading/unloading device according to claim 8, wherein:

said cartridge engaging member comprises a semi-circular member having a tab on one end for pressing a cartridge into said clip.

11. A cartridge clip loading/unloading device according to claim 1, wherein:

said clip has a plurality of slots for receiving said cartridges.

* * * * *

UNITED STATES PATENT AND TRADEMARK OFFICE

CERTIFICATE OF CORRECTION

PATENT NO. : 5,083,393

DATED : January 28, 1992

INVENTOR(S) : SMYDA

It is certified that error appears in the above-identified patent and that said Letters Patent is hereby corrected as shown below:

The Title page should be deleted to appear as per attached Title page.

Signed and Sealed this

Sixteenth Day of March, 1993

*Attest:*

STEPHEN G. KUNIN

*Attesting Officer*

*Acting Commissioner of Patents and Trademarks*

United States Patent [19]

Smyda

[11] Patent Number: 5,083,393

[45] Date of Patent: Jan. 28, 1992

[54] CARTRIDGE CLIP LOADING/UNLOADING TOOL

[76] Inventor: Eugene Smyda, 4002B E. 11th Street, Panam City, Fla. 32404

[21] Appl. No.: 683,796

[22] Filed: Apr. 11, 1991

[51] Int. Cl.[5] ..... F41A 9/85

[52] U.S. Cl. ..... 42/90; 42/89

[58] Field of Search ..... 42/87, 88, 89, 90

[56] References Cited

U.S. PATENT DOCUMENTS

| | | | |
|---|---|---|---|
| 923,068 | 5/1909 | Neal | 42/89 |
| 1,202,342 | 10/1916 | Wesson | 42/89 |
| 1,202,343 | 10/1916 | Wesson et al. | 42/89 |
| 2,451,521 | 10/1948 | Uglum | 42/87 |
| 3,182,417 | 5/1965 | Hamilton | 42/89 |

*Primary Examiner*—Charles T. Jordan
*Attorney, Agent, or Firm*—John K. Donaghy

[57] ABSTRACT

A cartridge clip loading/unloading device comprising a base; a post on the base having a terminal end; a clip having slots supported on the post at the terminal end; a tool having a first arm supported for rotation on the post; and a second arm having means for pressing cartridges onto or out of the clip.

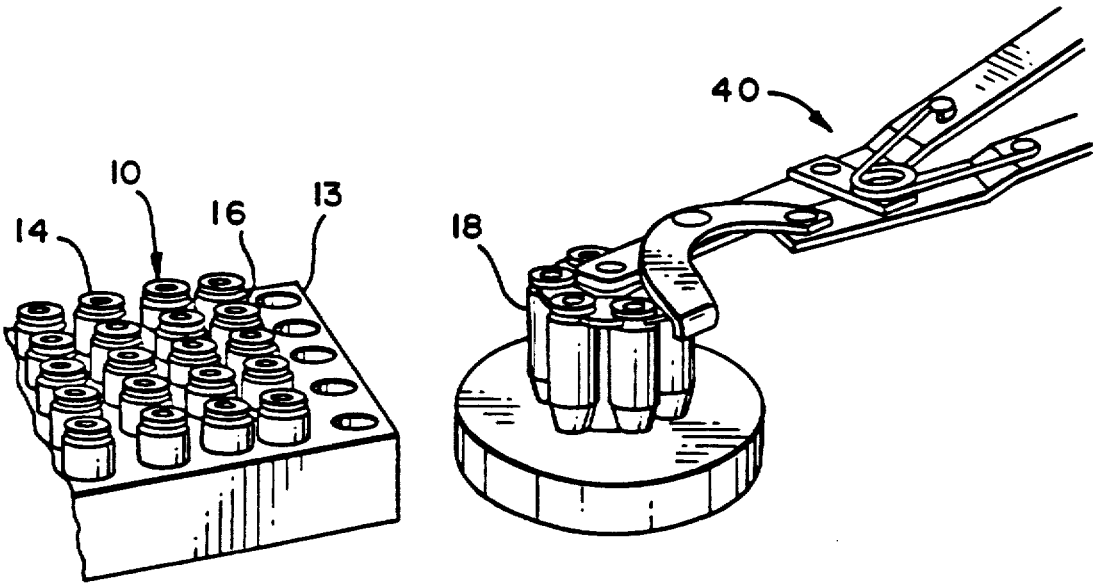

11 Claims, 3 Drawing Sheets